United States Patent [19]

Leps

[11] Patent Number: 4,955,606

[45] Date of Patent: Sep. 11, 1990

[54] BALL PITCHING DEVICE

[76] Inventor: Thomas Leps, 34 Wolfe Grade, Kentfield, Calif. 94904

[21] Appl. No.: 455,999

[22] Filed: Dec. 22, 1989

[51] Int. Cl.[5] ..... A63B 69/00

[52] U.S. Cl. ..... 273/26 D

[58] Field of Search ..... 273/26 R, 29 A, 201; 124/47

[56] References Cited

U.S. PATENT DOCUMENTS

| | | | |
|---|---|---|---|
| 2,955,823 | 10/1960 | Chanko | 273/26 D |
| 2,955,824 | 10/1960 | Chanko | 273/26 D |
| 4,132,214 | 1/1979 | Schnurr et al. | 273/29 A |
| 4,538,810 | 9/1985 | Brophy | 273/29 A |
| 4,548,407 | 10/1985 | Sato | 273/29 A |
| 4,803,372 | 5/1989 | Outlaw | 273/29 A |

*Primary Examiner*—Theatrice Brown

*Attorney, Agent, or Firm*—Larry D. Johnson

[57] ABSTRACT

A ball pitching device comprises a ball capture cavity bearing a lip member positioned to capture and stabilize a single ball at that level. An initial ramp extends downward and rearward away from the ball capture cavity, and connects to a final ramp which extends further downward but in the opposite (forward) longitudinal direction. The final ramp terminates in an upwardly-curved launch ramp extending towards the batter in the front of the apparatus, so that the launch ramp is generally beneath the ball capture cavity. The entire apparatus is supported by an adjustable-height stand, and may include a ball magazine for containing a plurality of balls.

8 Claims, 3 Drawing Sheets

BALL PITCHING DEVICE

BACKGROUND OF THE INVENTION

1. Field of the Invention

This invention relates generally to recreational apparatus, and more specifically to an improved ball pitching device as used in a soft-toss drill.

2. Description of the Prior Art

Baseball, softball and related sports are very popular, and numerous mechanical devices have been developed to assist and train players of the games. For example, several types of pitching or ball toss machines have been designed to enable a player to practice his batting skills without requiring another player to manually pitch the ball to him. Most such ball toss machines utilize a motor to sequentially throw the ball to the batter, or to release the ball down an inclined ramp and into the batter's "strike zone" for hitting. Such motorized devices are, by their very nature, relatively complex and expensive, and therefore not readily available to many consumers. More significantly, these devices require a power supply, usually in the form of an electrical extension cord extended to the nearest electrical outlet, or use of a portable electric generator, in order to operate. Thus, these devices are not always able to be used where desired, as in an open field or ballpark.

Other ball toss devices have been developed which are not motorized and do not require electrical power, but rather require manual operator release of a ball down a chute or tube towards an upwardly inclined extension, to gently "pitch" the ball to the batter. However, the release mechanisms on known manual devices are often poorly positioned and/or difficult for the operator/batter to manipulate. Furthermore, due to the structural geometry and arrangement of their release mechanisms and chutes, these known manual devices deliver the ball to the batter's strike zone very quickly, so that the batter has little time to set up and prepare to swing. Thus, such devices are often not desirable as practice or teaching tools.

SUMMARY OF THE INVENTION

The ball pitching device of this invention provides a portable, collapsible structure designed to selectively pitch a ball to a batter in a "soft-toss" drill, as used to develop a batter's hand, wrist, and eye coordination. The device comprises a ball capture cavity portion bearing a lip member positioned to capture and stabilize a single ball at that level. An initial or "delay" ramp portion extends downward and rearward away from the ball capture cavity, and connects to a final or "acceleration" ramp portion which extends further downward but in the opposite longitudinal direction, forward in the direction of the ball capture cavity. The final ramp terminates in an upwardly-curved launch ramp portion extending towards the batter in the front of the apparatus, so that the launch ramp is generally beneath the ball capture cavity. The entire apparatus may be supported at any appropriate height by an adjustable-height stand.

In the preferred embodiment, the device includes at least one ball magazine portion having a front end and a rear end, which is used for containing one or more balls to be pitched. The magazine is inclined generally downwardly from the rear to the front, and terminates at its front (i.e., lower) end into the ball capture cavity portion. Thus, the device can be used as a single-ball mechanism, or a repeatable ball pitching mechanism, as desired.

The ball pitching device is used in the following manner: at least one ball is placed in the ball capture cavity (or the magazine, where the ball naturally rolls forward until it enters the ball capture cavity), so that it is (temporarily) held in place there by the lip member. The batter, standing in front of the apparatus in a batting stance (so that his feet are in the proper position when he hits the ball), reaches up to touch the ball with the barrel end of his bat through a bat access port opening in the ball capture cavity, so that the ball is gently pushed over the lip member, and begins to roll downwards and away from the batter on the initial (delay) ramp. This initial ramp is preferably relatively gently inclined, so that the ball rolls relatively slowly down it. The ball rolls the length of the initial ramp until it contacts the final (acceleration) ramp, where the ball changes direction and rolls down the final ramp towards the front of the apparatus. This final ramp is preferably relatively steeper than the initial ramp, so that the ball attains an appropriate rolling velocity. The ball rolls the length of the final ramp and then rolls up the upwardly-curved launch ramp, leaving the launch ramp in a ballistic trajectory towards the batter's strike zone.

The effect of the combination of these dual ramps (initial and final) is that the ball is delayed in its delivery to the batter for a desired interval, e.g., three to four seconds, which time is analagous to the time it takes for a typical baseball pitcher to wind up and deliver a ball to a batter in a real game. Thus, use of the ball pitching device of this invention replicates a real ball game in that respect. In addition, this time interval gives the batter time to think and properly prepare for the ball (e.g. head down, bat in position), thereby further enhancing the training process.

The ball pitching device of this invention is heightadjustable, enabling the batter to adjust the device to deliver the ball into all areas of the strike zone for batting practice, and adjustable for all height of batters. Furthermore, the inventive device is completely collapsible and portable, enabling its use by individuals in any playing area or park. Finally, because it does not require electric power, the device is safe to be used in all types of weather.

DETAILED DESCRIPTION OF A PREFERRED EMBODIMENT

Figure 1:
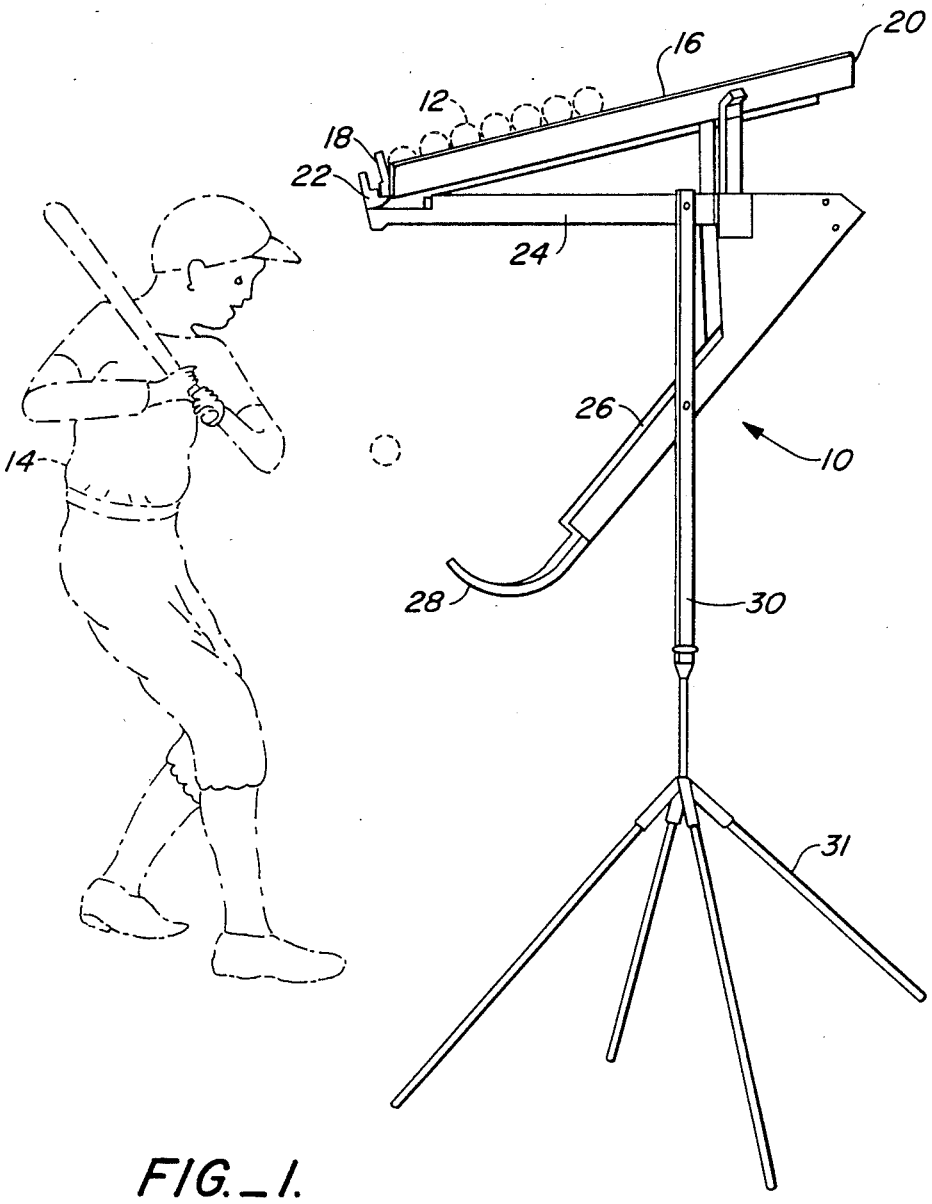
FIG. 1 is a side view of a ball pitching device of this invention as assembled and in operation to selectively deliver a ball in soft-toss fashion to a batter (shown in phantom lines), and illustrating the ball magazines, initial ramp, final ramp, and launch ramp portions of the device, all as supported by a height-adjustable stand.

FIG. 1 is a side view of a ball pitching device 10 of this invention as assembled and in operation to selectively deliver a ball 12 in soft-toss fashion to a batter 14 (shown in phantom lines). The device comprises at least one ball magazine portion 16 having a front end 18 and a rear end 20, used for containing one or more balls to be pitched. The magazine is inclined generally downwardly from the rear to the front, and terminates at its front (i.e., lower) end in a ball capture cavity portion 22 bearing a lip member (not visible in this view) positioned to capture and stabilize a single ball at that level. Alternatively, the device may be used without the ball magazine portion, requiring only that a single ball be placed one at a time in the ball capture cavity for use. An initial or "delay" ramp portion 24 extends downward and rearward away from the ball capture cavity, in the general direction of the magazine rear end, and connects to a final or "acceleration" ramp portion 26 which extends further downward but in the opposite longitudinal direction, forward in the direction of the magazine front end and ball capture cavity. The final ramp terminates in an upwardly-curved launch ramp portion extending towards the batter in the front of the apparatus, so that the launch ramp 28 is generally beneath the ball capture cavity 22. The entire apparatus is supported at an appropriate height by an adjustable-height stand 30, which may include three, four, or more legs 31.

Figure 2:
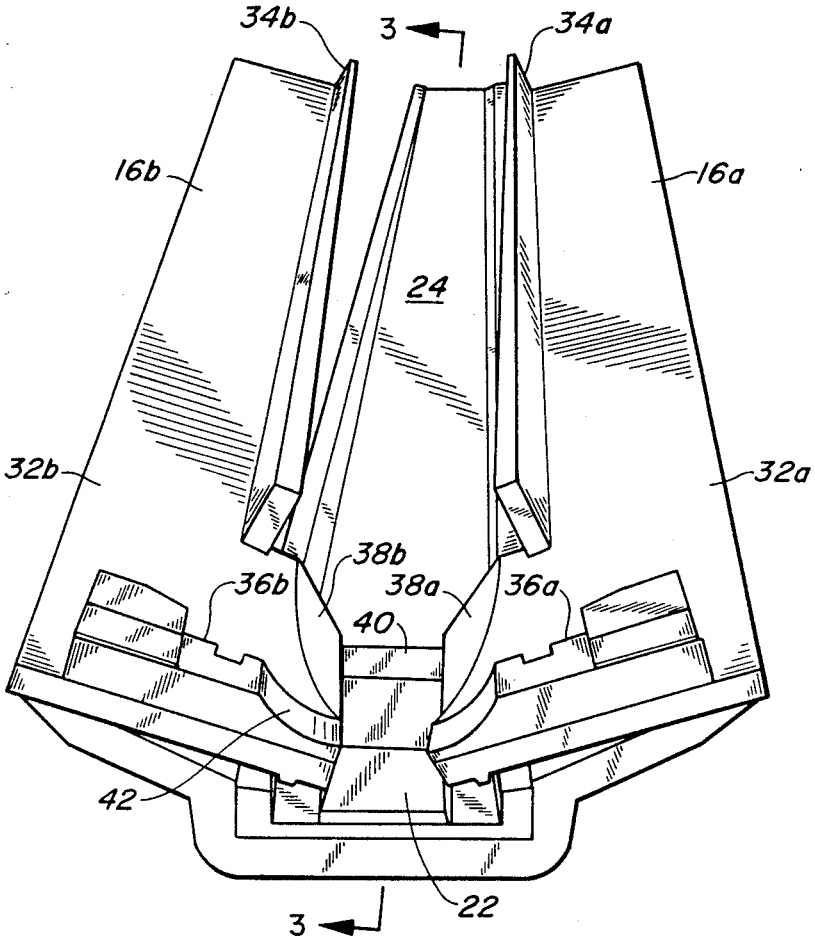
FIG. 2 is a top perspective view of the ball magazine and initial ramp portions of the ball pitching device of this invention, illustrating the magazine ramps, walls, and loading surfaces; the ball capture cavity and lip member, and the bat access port portions of the device.

FIG. 2 is a top perspective view of a pair of ball magazines 16*a*, 16*b* and initial ramp portion 24 of the ball pitching device of this invention. This view illustrates the magazine ramps 32*a*, 32*b*, side walls 34*a*, 34*b*, front wall 36*a*, 36*b*, and loading surfaces 38*a*, 38*b*. These loading surfaces urge a single ball at a time into the ball capture cavity 22 (e.g., by placement of a removable stop member adjacent one magazine, permitting only the other magazine to feed the ball capture cavity), where lip member 40 temporarily stabilizes the ball. Bat access port 42 provides an opening to enable the batter to touch the ball in the ball cavity, and dislodge it from its rest position there to begin its roll down the initial ramp.

The ball magazines 16*a*, 16*b* can of course be constructed in any size to accomodate any desired quantity of balls. In the preferred embodiment, the magazines are sized to hold approximately fourteen hardballs each, or eleven softballs each. Thus, the entire apparatus would accomodate twenty-nine hardballs (fourteen in each of the two magazines plus one in the ball capture cavity) or twenty-three softballs.

Figure 3:
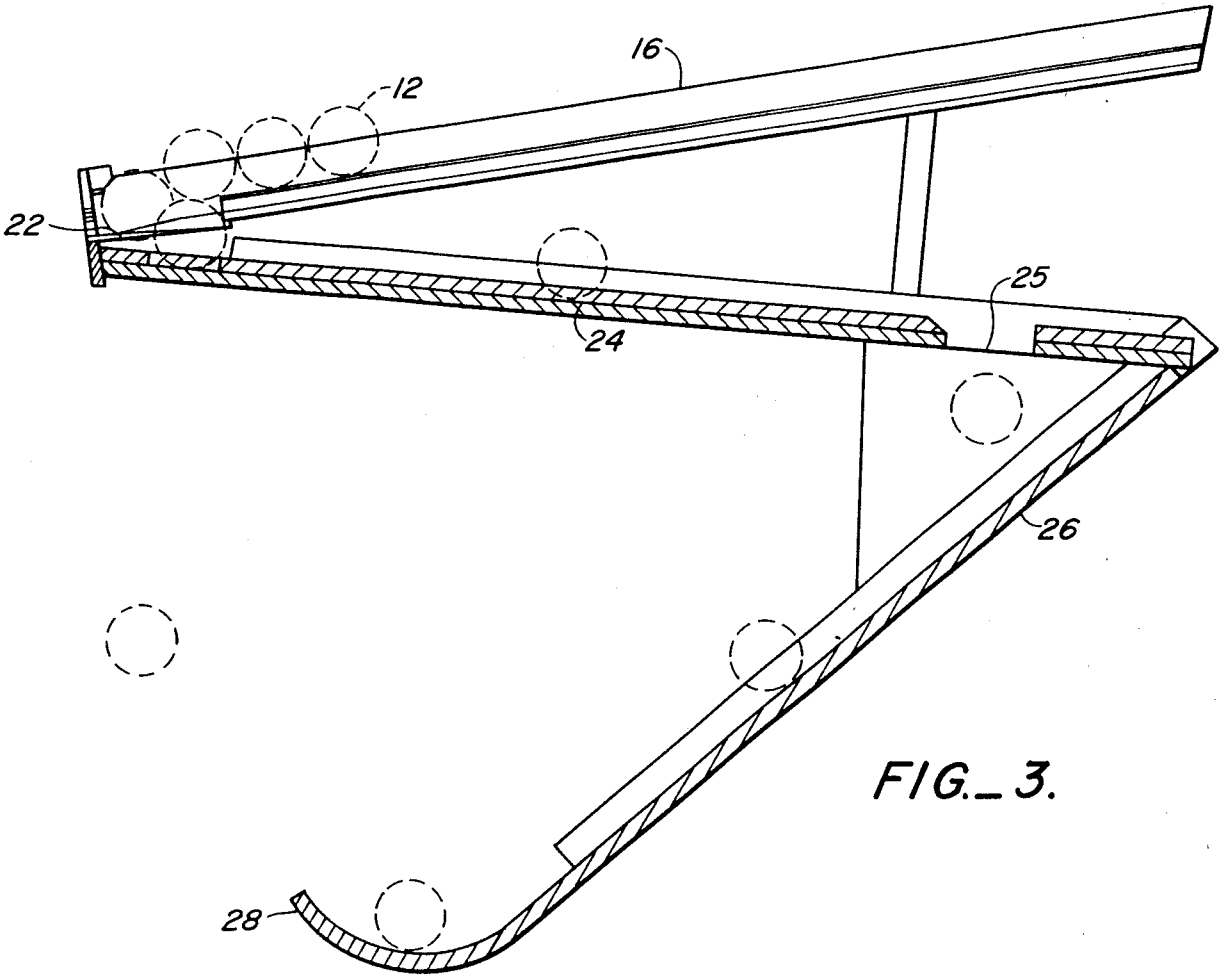
FIG. 3 is a side elevation view in partial cross-section of the ball pitching device of this invention, this view taken along line 3—3 of FIG. 2, illustrating a plurality of balls (shown in phantom lines) from a ball magazine being sequentially fed from the ball magazine into the ball capture cavity for selective release down the initial ramp, through the ramp drop, and to the final ramp and launch ramp for delivery to a batter's strike zone.

FIG. 3 is a side elevation view in partial cross-section of the ball pitching device of this invention, this view taken along line 3—3 of FIG. 2, illustrating a plurality of balls (shown in phantom lines) being sequentially fed from the ball magazine into the ball capture cavity for selective release down the initial ramp. The ball travel path is as follows: at least one ball 12 is placed in the magazine 16, where it naturally rolls forward until it enters the ball capture cavity 22, so that it is (temporarily) held in place there by the lip member (not visible in this view). The batter, standing in front of the apparatus, reaches up to touch the ball with the end of his bat through a bat access port opening 42 in the ball capture cavity, so that the ball is gently pushed over the lip member, and begins to roll downwards and away from the batter on the initial ramp 24. The ball rolls the length of the initial ramp and down through ramp drop 25 until it contacts the final (acceleration) ramp 26, where the ball changes direction and rolls down the final ramp towards the front of the apparatus. The ball rolls the length of the final ramp and then rolls up the upwardly-curved launch ramp 28, leaving the launch ramp in a ballistic trajectory towards the batter's strike zone.

While this invention has been described in connection with preferred embodiments thereof, it is obvious that modifications and changes therein may be made by those skilled in the art to which it pertains without departing from the spirit and scope of the invention. For example, the device could be constructed of wood, metal, or any suitable material. Furthermore, the ramps do not have to be linear, but could be curved, as long as they together provide the desired attributes of control and durational delay. Accordingly, the scope of this invention is to be limited only by the appended claims.

What is claimed as invention is:

1. A ball pitching device comprising:

a support stand structure;

a ball capture cavity portion attached to said support stand structure, said ball capture cavity portion bearing a lip member, said lip member conditioned to capture and temporarily stabilize a ball placed in said ball capture cavity portion;

an initial ramp portion connected to said ball capture cavity portion, said initial ramp portion extending downward and rearward away from said ball capture cavity portion;

a final ramp portion connected to said initial ramp portion, said final ramp portion extending downward and forward from said initial ramp portion in the longitudinal direction of said ball capture cavity; and an upwardly-curved launch ramp portion connected to said final ramp portion, said launch ramp portion extending generally beneath said ball capture cavity portion.

2. The ball pitching device of claim 1 including at least one ball magazine portion having a front end and a rear end, said ball magazine portion connected to said support stand structure so that said front end is inclined downwardly from said rear end, said ball magazine portion terminating in said ball capture cavity portion.

3. The ball pitching device of claim 1 wherein said support stand structure is adjustable in height.

4. The ball pitching device of claim 2 including a pair of ball magazine portions jointly connected to said ball capture cavity portion.

5. The ball pitching device of claim 1 wherein said initial ramp portion is relatively less inclined than said final ramp portion.

6. The ball pitching device of claim 1 wherein said device is collapsible.

7. The ball pitching device of claim 1 wherein said ball capture cavity portion includes an access port enabling insertion of the barrel end of a bat.

8. The ball pitching device of claim 1 wherein said initial ramp portion and said final ramp portion are linear.

* * * * *